US005596841A

United States Patent [19]

Gentry et al.

[11] Patent Number: 5,596,841

[45] Date of Patent: Jan. 28, 1997

[54] MAILBOX WITH SIGNAL DEVICE

[76] Inventors: Paul E. Gentry; Barbara J. Gentry, both of P.O. Box 6042, Biloxi, Miss. 39532

[21] Appl. No.: 429,335

[22] Filed: Apr. 26, 1995

[51] Int. Cl.[6] ..... B65D 91/00

[52] U.S. Cl. ..... 49/35

[58] Field of Search ..... 232/34, 35, 17, 232/43.4; D99/29

[56] References Cited

U.S. PATENT DOCUMENTS

| | | | |
|---|---|---|---|
| D. 278,469 | 4/1985 | Ross | D99/29 |
| 2,480,469 | 8/1949 | Horn | 232/34 |
| 3,586,235 | 6/1971 | Fishel | 232/35 |
| 3,589,329 | 6/1971 | Schuh | 232/35 |
| 4,005,816 | 2/1977 | Malik | 232/35 |
| 4,205,778 | 6/1980 | File | 232/35 |
| 4,220,278 | 9/1980 | Hasselbring | 232/35 |
| 4,720,042 | 1/1988 | Taby | 232/35 |
| 4,728,028 | 3/1988 | Barnes | 232/35 |
| 5,092,517 | 3/1992 | Jeffries | 232/35 |

*Primary Examiner*—Kenneth J. Dorner
*Assistant Examiner*—Jerry Redman
*Attorney, Agent, or Firm*—Joseph N. Breaux

[57] ABSTRACT

A mailbox of the type having an elongated housing, a front closure pivotally mounted on a front end of the housing for depositing articles therein, a rear closure pivotally mounted on the rear end of the housing for removing articles from the mailbox, a signal device on the mailbox movable between a first and second position and a flexible cable, slidably disposed within a cable conduit, having one end connected to the front closure and the other end connected to the signal device for moving the signal device from a first position to a second position upon moving the front closure from a closed to an open position. Entry into the mailbox through the front closure raises the signal device indicating that the mailman has visited the box.

3 Claims, 2 Drawing Sheets

MAILBOX WITH SIGNAL DEVICE

TECHNICAL FIELD

The present invention relates to devices for deposit and collection of mail and more particularly to devices for signalling the arrival of mail.

BACKGROUND ART

Very often, especially in rural areas, mailboxes are located a considerable distance from an owner's residence. Due to this distance it is inconvenient for the owner of the box to continuously check the mailbox for delivery of the mail. There are devices which signal the arrival of mail when the mail-entry door is opened. However, these devices are complicated and often use the outgoing mail flag as a signal flag, thereby, negating any benefit to the owner when there is outgoing mail. In addition, it is common for mailboxes to only be accessible from the road, thus, placing the person retrieving the mail in the path of passing traffic.

It would be a benefit, therefore, to have a mailbox which provides a mail entry access and a mail retrieval access. It would further be a benefit to have a simple signal device which is activated by the opening of the mail entry door in addition to the outgoing mail signal.

GENERAL SUMMARY DISCUSSION OF INVENTION

It is thus an object of the invention to provide a mailbox with signal device that provides a simple and safe means of access for the owner of the box.

It is a further object of the invention to provide a mailbox with signal device that will indicate when the mailman has visited the premises that is simple to manufacture.

It is a still further object of the invention to provide a mailbox with signal device that will separately indicate the arrival of the mailman and that there is outgoing mail in the mailbox.

Accordingly, an improved mailbox is provided of the type having an elongated housing including a front end, a rear end and a flat bottom; a front closure for the front end of the housing, movable from a closed position to an open position; and a rear closure for the rear end of the housing, movable from a closed position to an open position. The improvement to the mailbox comprises: a signal device movable between a first and second predetermined position; a cable conduit in connection with the housing, having an initial and a terminal orifice, the initial orifice being disposed adjacent to the signal device and the terminal orifice being disposed adjacent the front closure; and a flexible cable, a substantial portion thereof slidably disposed within the cable conduit, having a first end functionally connected to the signal device and a second end functionally connected to the front closure, and of a length sufficient for moving the signal device from the first predetermined position to the second predetermined position upon moving the front closure from the closed to the open position. When the front closure is opened the flexible cable is urged in the direction of the front closure sliding within the cable conduit moving the signal device from the first predetermined position to the second predetermined position. When the front closure is then closed the front closure slides in relation to the flexible cable and the signal device remains in the second predetermined position. The elongated housing may be of any conventional or desired design, and constructed of any durable, moldable material such as metal or plastic.

The signal device may include an elongated signal member or flag which is mounted on the side of the mailbox housing and movable between a first and second predetermined position. Preferably, the elongated signal member is oriented parallel with the bottom of the housing when in the first predetermined position and oriented perpendicular to the bottom when in the second predetermined position. The elongated signal member may be of any design or construction which is noticeable from a distance when in the second predetermined position. Preferably, the elongated signal member is mounted on a pivot pin which is resistively mounted within a base in a manner such that the elongated signal member tends to remain in whatever position it is brought to.

The cable conduit may be a sleeve member having a first and a second open end forming a conduit in between. The sleeve may be of any durable material, such as plastic, metal or hard rubber, capable of maintaining the flexible cable in a fixed path. The sleeve may only encase a portion of the flexible cable necessary to maintain the cable in a fixed position. However, the sleeve may encase a substantial portion of the flexible cable. The sleeve may be rigidly connected to the inner or outer sidewall of the mailbox housing. Preferably, the sleeve member is rigidly connected to the housing in a position such that the flexible cable tends to move the elongated signal member from the first predetermined position to the second predetermined position when the front closure is opened.

In another preferred embodiment, the cable conduit is a passageway molded or formed within the sidewall of the mailbox housing. The initial orifice is positioned on the sidewall so that the flexible cable tends to move the elongated signal member from the first predetermined position to the second predetermined position when the front closure is opened. The terminal orifice may be formed on the face of the front end of the housing. Preferably, the terminal orifice is flared or bevelled so that the flexible cable smoothly slides when the front closure is opened.

The flexible cable is a small diameter steel cable such as is used in bicycle hand brakes. The first end of the flexible cable is functionally connected to the elongated signal member. "Functionally connected" as used herein, means: connected in a manner such that the flexible cable will act on the connected member in at least one direction. The flexible cable may be slidably connected to the elongated signal member. Preferably, the flexible cable is rigidly connected to the elongated signal member.

The second end of the flexible cable is functionally connected to the front closure. The flexible cable may be rigidly connected to the front closure. The second end, preferably, is slidably connected to the front closure so that when the front closure is moved from the open to the closed position the elongated signal member is not moved.

The flexible cable is of a length such that when the front closure is in the closed position and the elongated signal member is in the first predetermined position the flexible cable is in tension. The flexible cable is oriented so that when the elongated signal member is in the first predetermined position the opening of the front closure will move the elongated signal member from to the second predetermined position.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
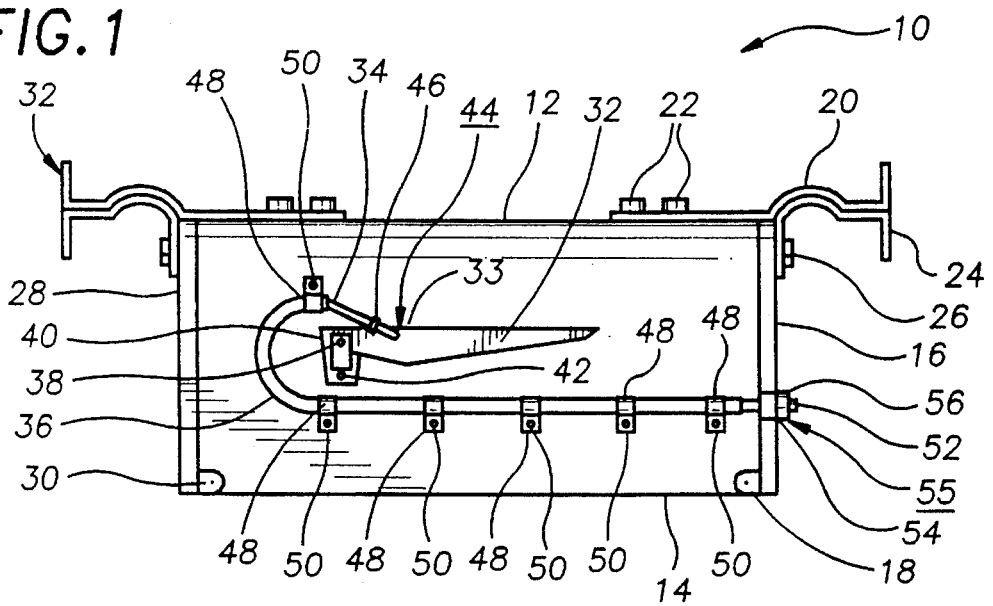
FIG. 1 is a side view of an exemplary embodiment of the mailbox with signal device, showing the elongated signal member in the first predetermined position and the front closure in the closed position.

FIG. 1 is a side view of an exemplary embodiment of the mailbox with signal device of the present invention designated generally as 10 having a curved housing 12 and a flat bottom 14 formed of metal in one rigid assembly. There is a front closure 16 mounted on small pivot pins 18 on opposite sides of housing 12. A latch arrangement of conventional construction comprising a concave receiver tongue 20, attached to the top of housing 12 with metal screws 22, and a convex latch 24, attached to front closure 16 with metal screws 26. An identical construction is found in the rear closure 28 which is mounted on small pivot pins 30 and held in place by the same sort of latch arrangement 32.

Mailbox 10 includes a mail arrival signal device having a signal flag 32 and a flexible cable 34 slidably encased within a plastic sleeve 36. Signal flag 32 is an elongated metal member pivotally mounted on pivot pin 38, which is held in place by a base 40. Base 40 is mounted, by rivet 42, on the outside of housing 12 about midway between flat bottom 14 and the top of housing 12 and about at the opposite end of mailbox 10 from front closure 16.

The first end 33 of flexible cable 34 passes through an aperture 44 formed on signal flag 32 and is fixedly secured by a saddle clamp 46. Sleeve 36 is rigidly connected to the side of housing 12, with clamps 48 and rivets 50. The second end 52 of flexible cable 34 is externally threaded and passes through an aperture 55, formed by a rib 54 soldered onto the side of front closure 16, and is slidably held in place by a locking nut 56. Rib 54 is located a distance from pivot pin 18 so that the arc of travel of rib 54 when front closure 16 is pivoted from the closed to the open position is equal to the arc of travel of aperture 44 when signal flag 32 is pivoted from the first predetermined position to the second predetermined position.

As shown in FIG. 1, signal flag 32 is in the first predetermined position indicating that front closure 16 has not been opened. The figure shows flexible cable 34 in tension and locking nut 56 flush with rib 54.

Figure 2:
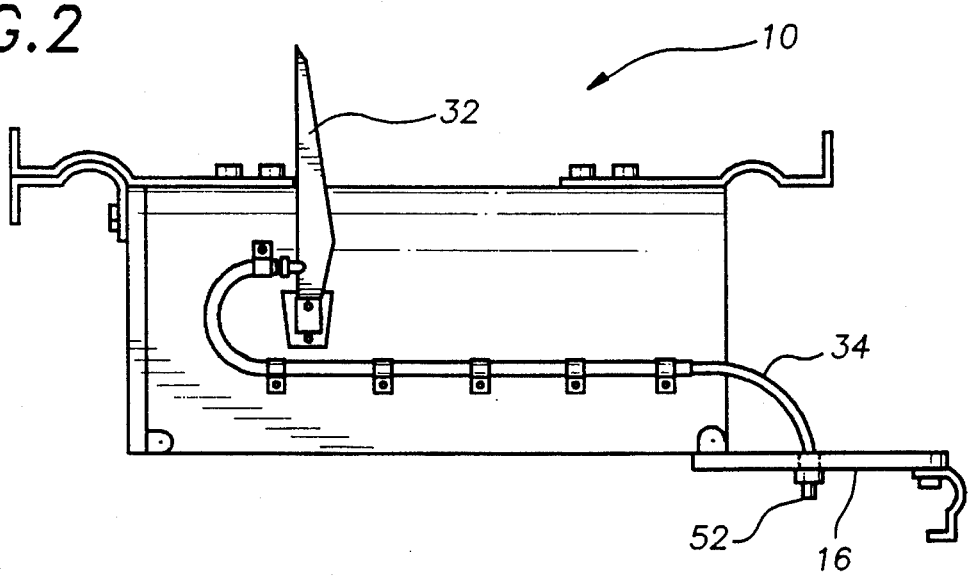
FIG. 2 is a side view of an exemplary embodiment of the mailbox with signal device, showing the elongated signal member in the second predetermined position and the front closure in the open position.

FIG. 2 is a side view of mailbox 10 with front closure 16 open. When front closure 16 is opened, for mail delivery, first end 52 of flexible cable 34 is urged in the direction of front closure 16 raising signal flag 32 to the second predetermined position. When in the second predetermined position signal flag 32 indicates to the owner of mailbox 10 that front closure 16 has been opened.

Figure 3:
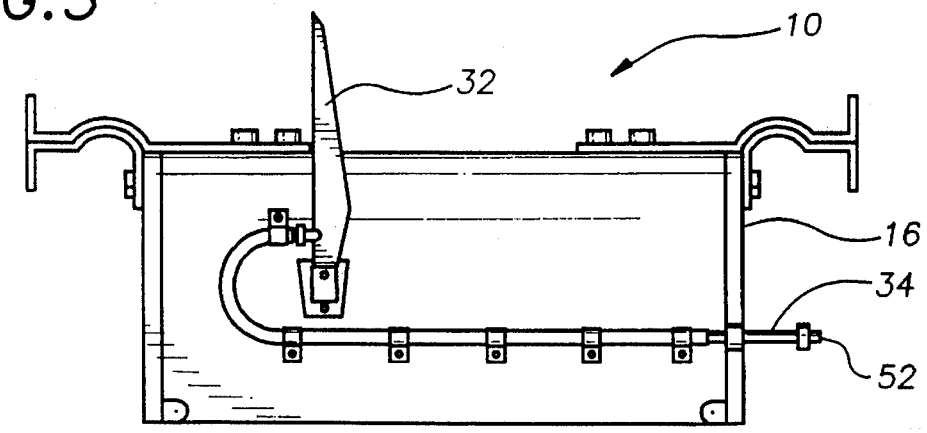
FIG. 3 is a side view of an exemplary embodiment of the mailbox with signal device, showing the elongated signal member in the second predetermined position and the front closure in the closed position.

FIG. 3 is a side view of mailbox 10 with front closure 16 closed and signal flag 32 in the second predetermined position. When front closure 16 is closed, after being opened raising signal flag 32 (FIG. 2), signal flag 32 remains in the second predetermined position with second end 52 of flexible cable 34 extending away from front closure 16.

Figure 4:
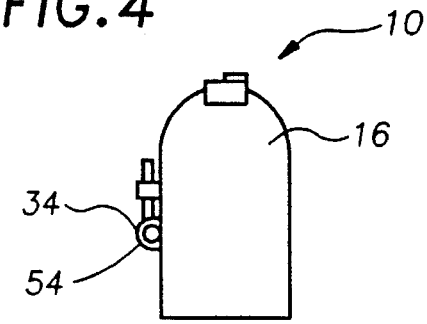
FIG. 4 is a front view of an exemplary embodiment of the mailbox with signal device, showing the elongated signal member in the first predetermined position and the front closure in the closed position.

FIG. 4 is a front view of mailbox 10 with front closure 16 closed. The figure shows rib 54 soldered onto an edge of front closure 16. Flexible cable 34 passes through aperture 55 formed through rib 54.

Figure 5:
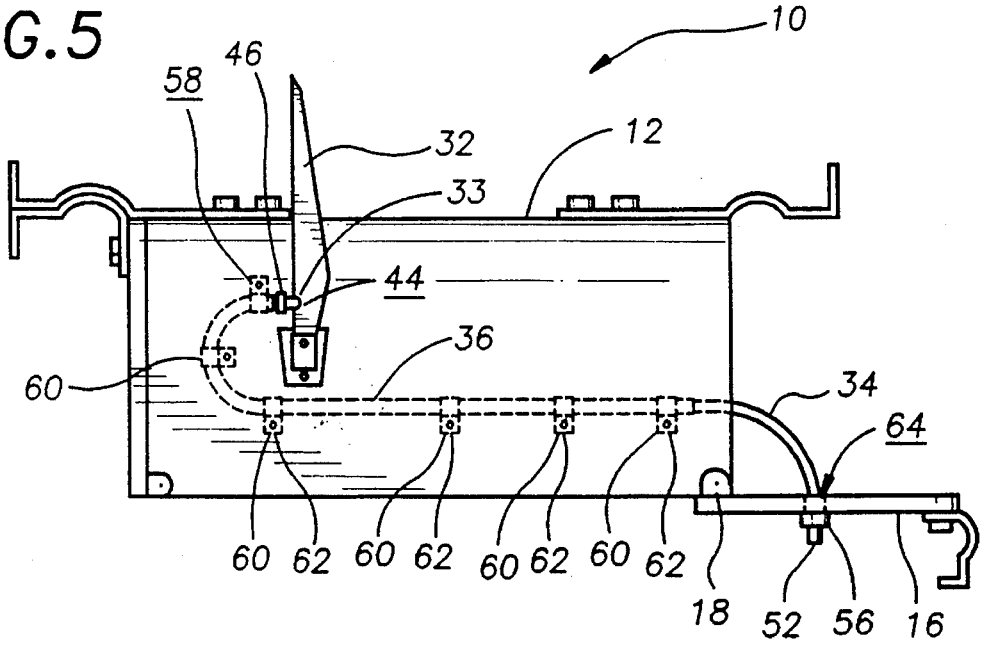
FIG. 5 is a side view of another exemplary embodiment of the mailbox with signal device, showing the elongated signal member in the second predetermined position and the front closure in the open position and the plastic sleeve rigidly connected to the inner sidewall of the mailbox housing.

FIG. 5 is a side view of another exemplary embodiment of the mailbox with signal device of the present invention designated generally as 10. Mailbox 10 includes a mail arrival signal device having a signal flag 32 and a flexible cable 34 slidably encased within a plastic sleeve 36 shown by the dotted lines.

The first end 33 of flexible cable 34 passes through an initial orifice 58 formed through the curved housing 12. The first end 33 of flexible cable 34 passes through an aperture 44 formed on signal flag 32 and is fixedly secured by a saddle clamp 46. Sleeve 36 is rigidly connected to the inner sidewall of housing 12, with clamps 60 and rivets 62. The second end 52 of flexible cable 34 is externally threaded and passes through an aperture 64 formed through front closure 16 and is slidably held in place by a locking nut 56. Aperture 64 is located a distance from pivot pin 18 so that the arc of travel of aperture 64 when front closure 16 is pivoted from the closed to the open position is equal to the arc of travel of aperture 44 when signal flag 32 is pivoted from the first predetermined position to the second predetermined position.

Figure 6:
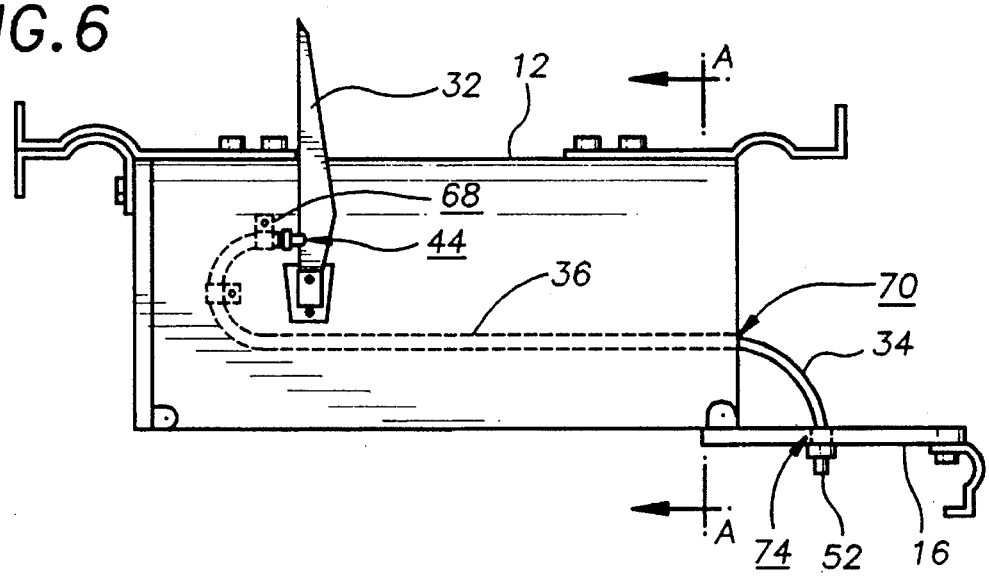
FIG. 6 is a side view of another exemplary embodiment of the mailbox with signal device, showing the elongated signal member in the second predetermined position and the front closure in the open position.

FIG. 6 is a side view of another exemplary embodiment of the mailbox with signal device of the present invention designated generally as 10 having a curved housing 12 formed of plastic. The figure shows a passageway 66, slidably encasing flexible cable 34, molded within the sidewall of housing Passageway 66 has an initial orifice 68 and a terminal orifice 70. Initial orifice 68 is positioned so that flexible cable 34 tends to raise signal flag 32 to the second predetermined position when front closure 16 is opened.

A door aperture 74 is formed through front closure 16 and concentrically aligned with terminal orifice 70 when front closure 16 is in the closed position. Second end 52 of flexible cable 34 passes through door aperture 74. Door aperture 74 is located a distance from pivot pin 18 such that the arc of travel of door aperture 74 when front closure 16 is pivoted from the closed to the open position is equal to the arc of travel of aperture 44 when signal flag 32 is pivoted from the first to the second predetermined position.

Figure 7:
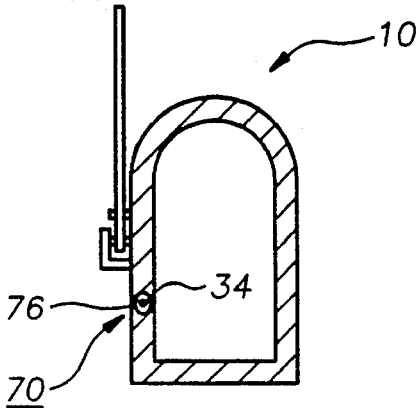
FIG. 7 is a cross-sectional end view of the mailbox with signal device, along the line A—A shown in FIG. 6.

FIG. 7 is a cross-sectional end view of mailbox 10 along the line A—A shown in FIG. 5. FIG. 6 shows terminal orifice 70. Terminal orifice 70 is flared and has a bevelled edge 76 to provide a smooth surface for the movement of flexible cable 34.

It can be seen from the preceding description that a device for signalling to a person when a mailman has visited a mailbox and for retrieving mail without stepping into the roadway has been provided.

It is noted that the embodiment of the mailbox with signal device described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. In a mailbox having an elongated housing including a front end, a rear end and a flat bottom; a front closure for said front end of said housing, movable from a closed position to an open position; and a rear closure for said rear end of said housing, movable from a closed position to an open position; the improvement comprising:

a signal device movable between a first and second position, said signal device including an elongated signal member pivotally mounted on said housing and a pivot pin having said elongated signal member mounted thereon in a manner such that said elongated signal member tends to remain in whatever position it is brought to;

a sleeve member, having an initial and a terminal orifice, in connection with said housing, said initial orifice being disposed adjacent said signal device and said terminal orifice being disposed adjacent said front closure;

a flexible cable, having a substantial portion thereof slidably disposed within said sleeve member, a first end functionally connected to said signal device and a second end functionally connected to said front closure, said flexible cable being of a length sufficient for moving said signal device from said first position to said second position upon moving said front closure from said closed position to said open position, said first end of said flexible cable extending beyond said initial orifice of said sleeve member and said second end of said flexible cable extending beyond said terminal orifice of said sleeve member; and a rib having a pathway formed therethrough attached to said front closure in a manner such that said pathway is substantially aligned with said terminal orifice of said sleeve member when said front closure is in said closed position, said second end of said flexible cable being disposed through and beyond said pathway of said rib.

2. In a mailbox having an elongated housing including a front end, a rear end and a flat bottom; a front closure for said front end of said housing, movable from a closed position to an open position; and a rear closure for said rear end of said housing, movable from a closed position to an open position; the improvement comprising:

a signal device, movable between a first and second position, having an elongated signal member pivotally mounted on one side of said housing and a pivot pin having said elongated signal member mounted thereon, sad pivot pin resistively connected within a base in a manner such that said elongated signal member tends to remain in whatever position it is brought to;

a sleeve member, having an initial orifice and a terminal orifice, rigidly connected to an outer sidewall of said housing, said initial orifice being disposed adjacent said signal device and said terminal orifice being disposed adjacent said front closure;

a flexible cable, having a substantial portion thereof slidably disposed within said sleeve member, a first end connected to said elongated signal member and a second end functionally connected to said front closure, said flexible cable being of a length sufficient for moving said elongated signal member from said first position to said second position upon moving said front closure from said closed position to said open position; and a rib having a pathway formed therethrough attached to said front closure in a manner such that said pathway is substantially aligned with said terminal orifice of said sleeve member when said front closure is in said closed position, said second end of said flexible cable being disposed through and beyond said pathway of said rib.

3. In a mailbox having an elongated housing including a front end, a rear end and a flat bottom; a front closure for said front end of said housing, movable from a closed position to an open position; and a rear closure for said rear end of said housing, movable from a closed position to an open position; the improvement comprising:

a signal device, movable between a first and second position, having an elongated signal member pivotally mounted on one side of said housing and a pivot pin having said elongated signal member mounted thereon, said pivot pin resistively connected within a base in a manner such that said elongated signal member tends to remain in whatever position it is brought to;

a cable passageway formed within one sidewall of said housing, having an initial and terminal orifice, said initial orifice is formed by said sidewall of said housing adjacent said signal device and said terminal orifice is flared and formed through said sidewall of said front end;

said front closure forms an aperture therethrough concentrically aligned with said terminals orifice of said passageway;

a flexible cable, having a substantial portion thereof slidably disposed within said passageway, a first end connected to said elongated signal member and a second end disposed through said aperture on said front closure and functionally connected thereto, said flexible cable being of a length sufficient for moving said elongated signal member from said first position to said second position upon moving said front closure from said closed position to said open position.

* * * * *